United States Patent [19]

Bösch

[11] 4,435,884

[45] Mar. 13, 1984

[54] CLIP-CHAIN TRACK FOR TENTER CLIPS

[75] Inventor: Alfred Bösch, Lustenau, Austria

[73] Assignee: Lindauer Dornier Gesellschaft mbH, Fed. Rep. of Germany

[21] Appl. No.: 306,416

[22] Filed: Sep. 28, 1981

Related U.S. Application Data

[63] Continuation-in-part of Ser. No. 280,017, Jun. 30, 1981, abandoned.

[30] Foreign Application Priority Data

Jul. 1, 1980 [DE] Fed. Rep. of Germany ..... 3024890

[51] Int. Cl.[3] ..... D06C 3/04

[52] U.S. Cl. ..... 26/93

[58] Field of Search ..... 26/72, 73, 91, 93, 94, 26/96

[56] References Cited

U.S. PATENT DOCUMENTS 3,580,451 5/1971 Fraitzl ..... 26/93 X

FOREIGN PATENT DOCUMENTS 51-31275 9/1976 Japan ..... 26/91

2032975 5/1980 United Kingdom ..... 26/91

*Primary Examiner*—Robert Mackey

*Attorney, Agent, or Firm*—James E. Bryan

[57] ABSTRACT

This invention relates to an improvement in a clip-chain track for tenter clips, with roller guidance in tenter frames for sheet material, composed of a clip-chain support with rod-like, endless and jointless guide rails of small cross-section mounted pairwise to the clip-chain support on both sides of the tensioning plane of the tenter chain, and with tensioning clip rollers resting by their running surfaces against the guide rails, the improvement comprising vertical spindle means connected to a clip body of the tenter clips and mounting separate support rollers and running rollers on both sides of a tensioning plane of a sheet material in two separate transverse planes of the spindle means, with the support rollers absorbing vertical forces and having slanted running surfaces of opposite inclinations, and separate support rails mounted on one side of their associated support rollers and running rails mounted on the other side of their associated running rollers in the transverse planes at the clip-chain support.

7 Claims, 4 Drawing Figures

CLIP-CHAIN TRACK FOR TENTER CLIPS

Figure 1:
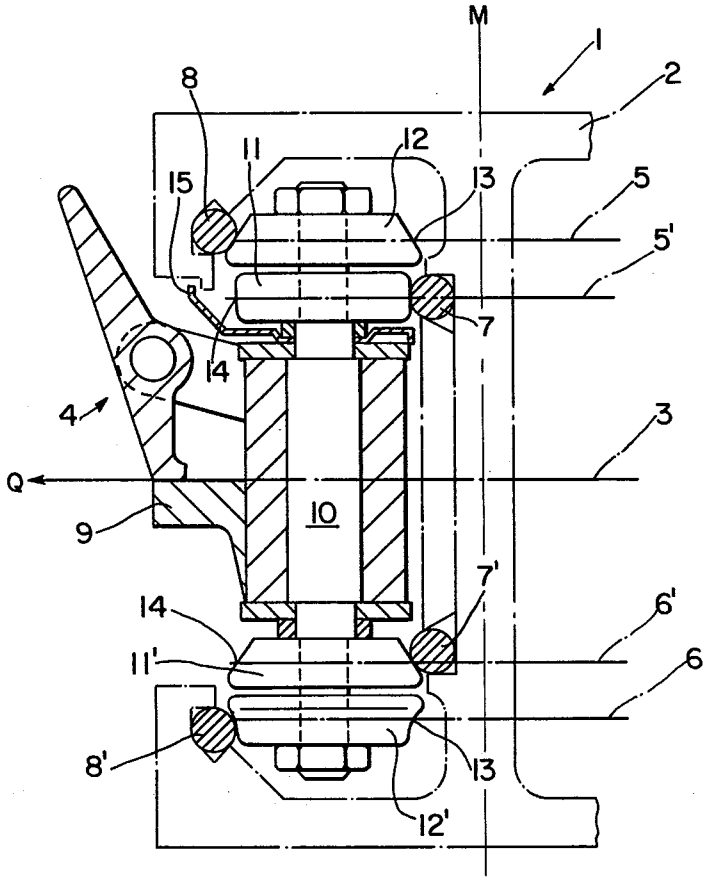

This application is a continuation-in-part of application Ser. No. 280,017, filed June 30, 1981, and now abandoned.

This invention relates to a clip chain track for tenter frames, composed of a clip chain support with pairwise, shaped cross-section, endless and jointless running and support rails mounted in the clip chain support on both sides of the clamping plane of the clip chain and being longitudinally displaceable in the same plane, and with running and supporting rollers resting on both sides thereon and with their running surfaces conformed to the profile of the running and support rails.

Numerous clip-chain tracks with running and guide rails are known in practice, which are used in the tenter frames of textile and foil-stretching machinery. The rollers of the clips provided to hold the edges of the treated length of material are supported on the running and guide rails against the vertical and horizontal forces generated in the process, and moreover they are also guided on the rails. As regards a clip chain track known from German Offenlegungsschrift No. 2,844,432, profiled running and support rails of slight cross-section conformed to the bearings with respect to contour, where these bearings are connected to the clip chain track, are mounted in a longitudinally displaceable manner above and below the clamping plane of the tenter clips. The running and support rollers arranged in the tenter clips in the same plane above and below the clamping plane rest on both sides on these running and support rails. The travel surfaces of the running and support rollers are conformed to the profile of the running and support rails.

The drawback relating to this known clip chain track especially is the relatively wide construction, projecting above the clip table and broadening the clip chain support on account of the horizontal arrangement of the running and support rollers and the arrangement of the running and support rails in one plane. This broadening in construction results in an additional stretching or bunching in the longitudinal direction of the clamped sheet material when the tenter clips are displaced in the transverse stretching zone. As a result, the edge of the sheet material may slip out of the tenter clips. The running and support rollers on the clip table side in this construction are located directly above or below the clip table, and especially the running and guide rollers located above drop oil from their bearings on the sheet material, which together with dust and soil results in soiling this sheet material and the formation of crusts at the edges. This is especially undesirable in foil materials.

Accordingly, it is the object of the present invention to so arrange the running and support rollers on the one hand and to support the running rails on the other hand that the clip bodies and the clip chain support are as compact as possible and thereby insure that there will be minimal longitudinal stretching or bunching of the edges of the sheet material in the transverse zone, avoiding a projection of the running and support rollers beyond the clip table and hence oiling and smudging thereof.

The advantage of the invention is especially that by arranging separate running and support rollers on vertical spindles and the associated running and support rails in different planes one above the other, the design width of the clip and of the clip chain support is reduced to a minimum. Thereby the distance between the clip table and its axis of rotation is restricted to a minimum and the clip table is exposed to no soiling due to its rollers and its spindles, and moreover the table is freely accessible from above and below. The vertical support of the clip or chain weight advantageously is assumed by the outer support rollers mounted to the spindle ends and resting by their running surfaces, which are designed to be oblique, conical or concave, against the support rails mounted to the inside of the clip chain support, the inside being in the vicinity of the sheet material to be treated. The transverse tensional forces acting on the clips are braced by running rails arranged on that side of the clip chain support which is away from the sheet material. Obviously, the running and support rollers rest with their cylindrical, conical or concave designed running surfaces against the running rails arranged on that side of the clip chain support which is away from the sheet material. Obviously, the running and support rails are not restricted to a specific arrangement; this arrangement also may be such that the support rails are located on that side of the clip chain support which is away from the sheet material and that the running rails are located in the vicinity of the sheet material. Due to the reduction in size so obtained for the clips and the clip chain support, one simultaneously obtains a reduction in the weight of the chain and hence of the drive forces, whereby an advantageous effect is obtained concerning the high speeds of the clip chain.

Figure 2:
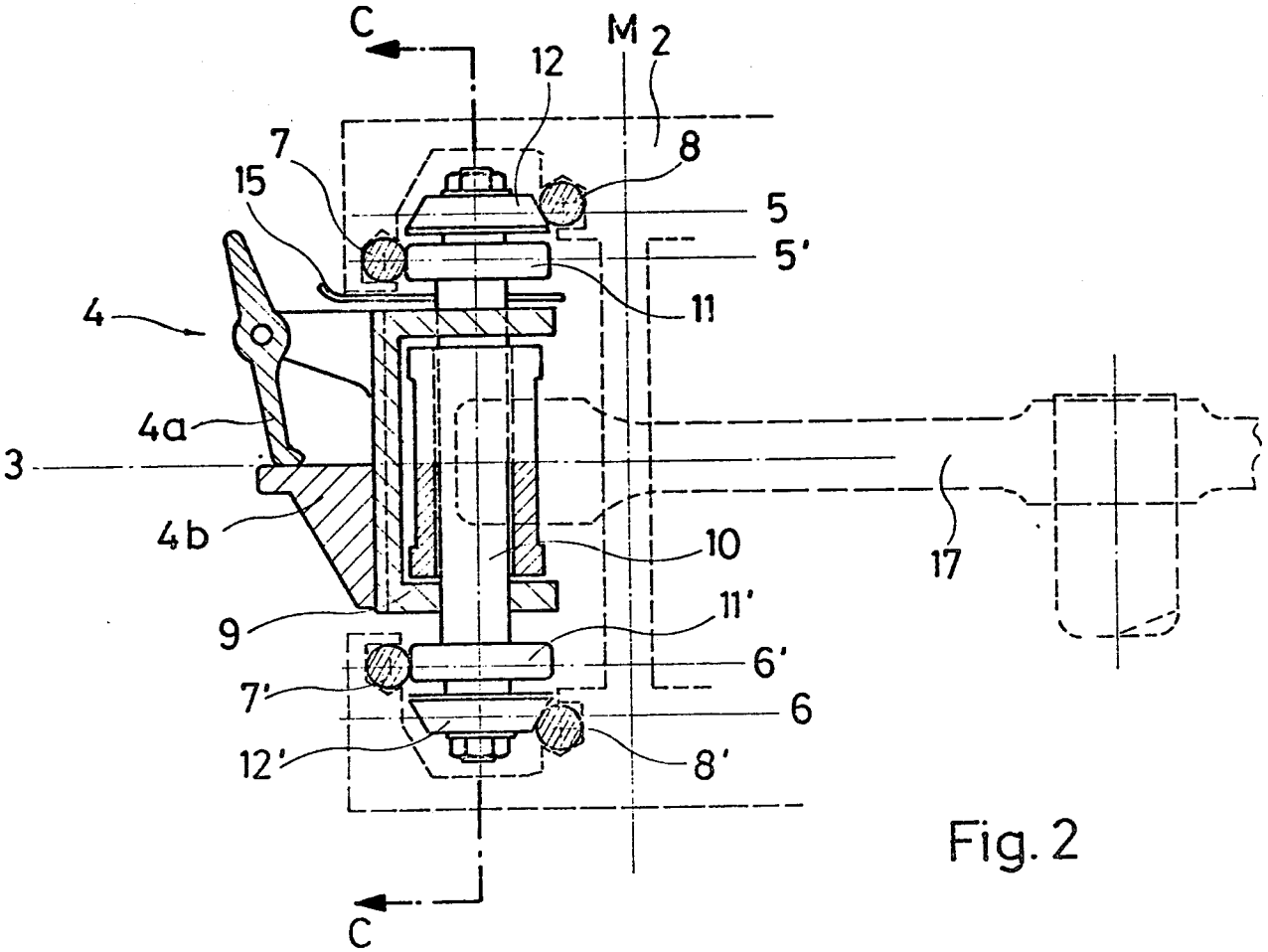
Figure 3:
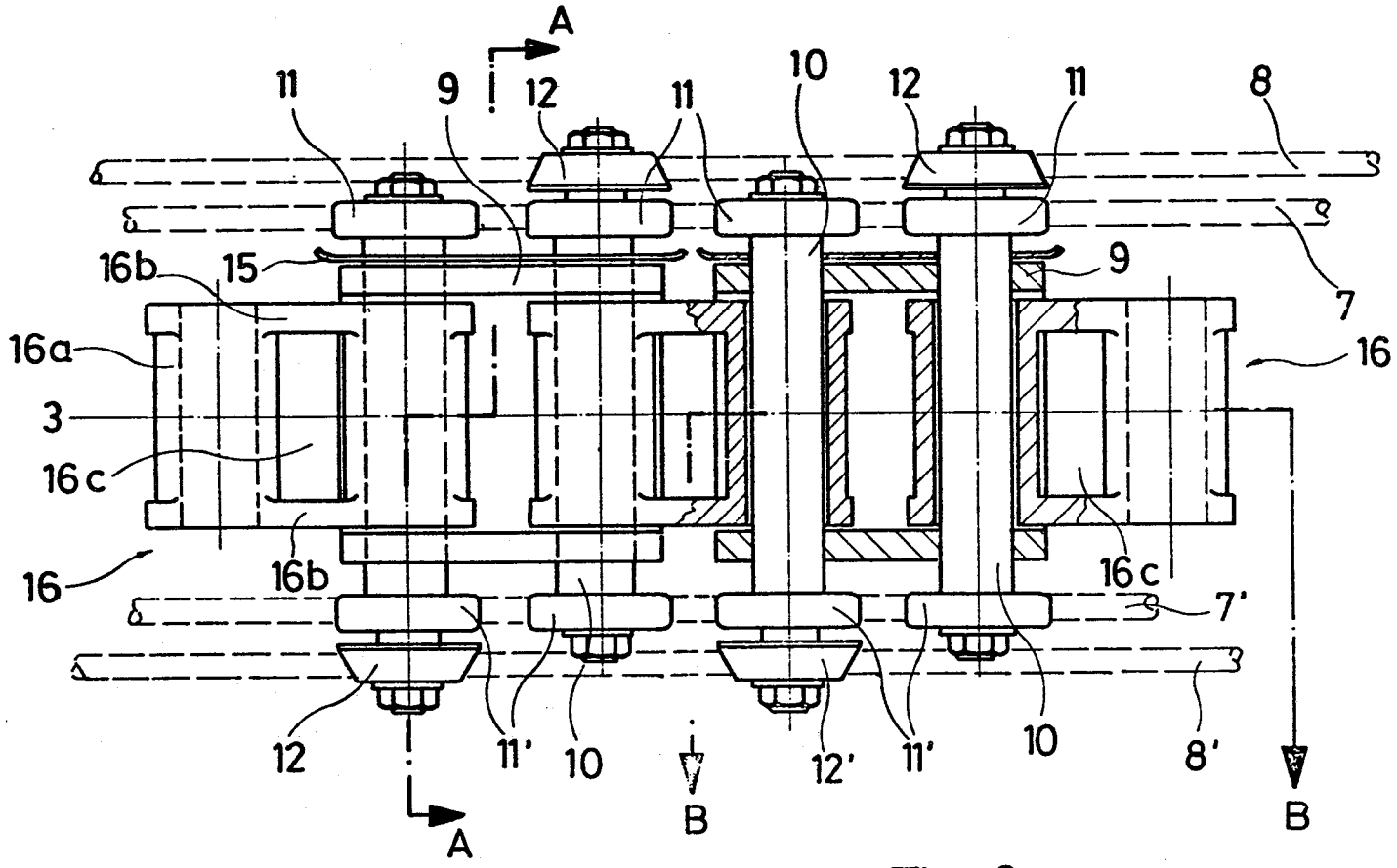
Figure 4:
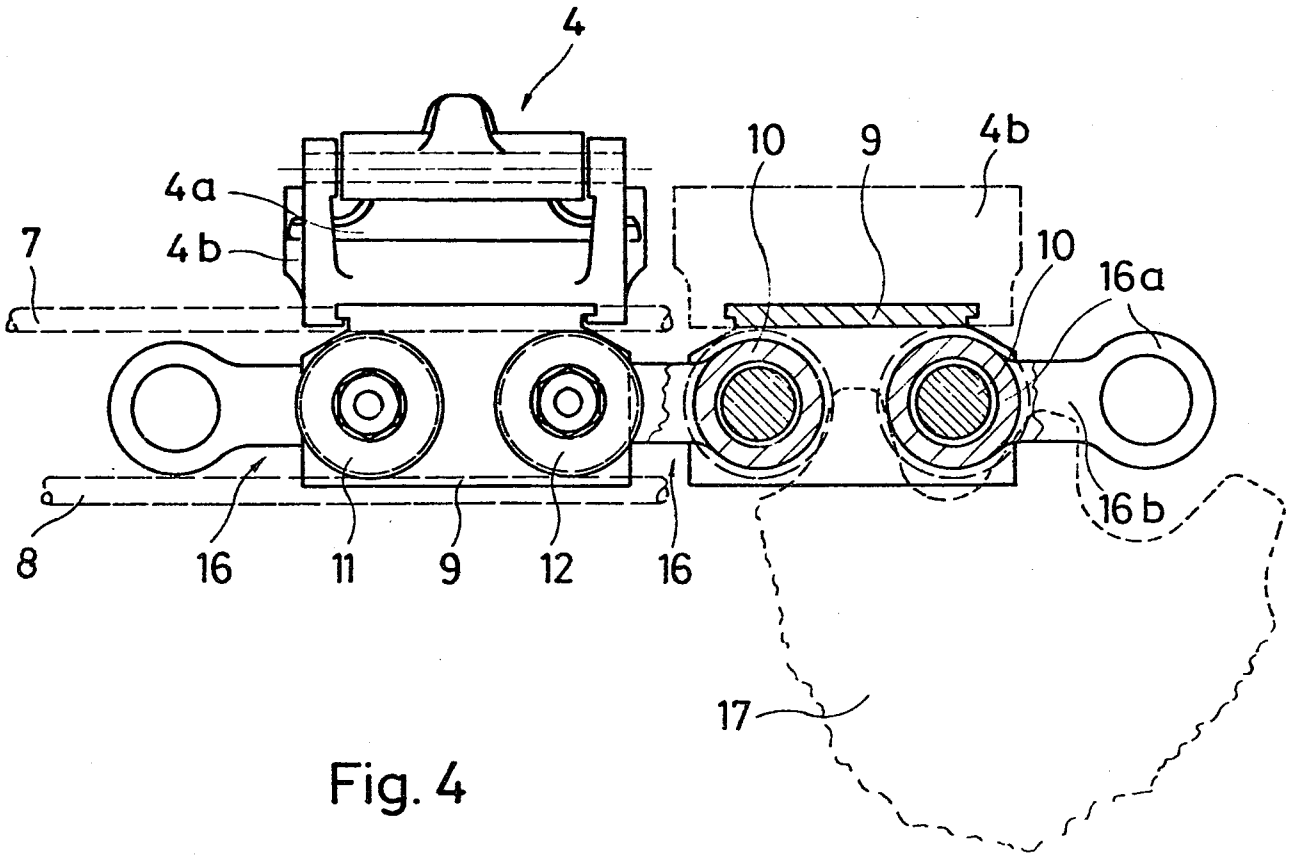

Illustrative embodiments are described below and discussed in relation to the accompanying drawings, in which:

FIG. 1 is a view in cross-section of a clip chain track with tenter clips guided therein and linked into a chain, FIG. 2 is a view in cross-section of another embodiment taken on line A—A of FIG. 3, FIG. 3 shows the links of a clip chain viewed from the side away from the sheet material, one clip being a modified vertical longitudinal view in cross-section taken on line C—C of FIG. 2, and FIG. 4 shows a top view of FIG. 3 with a horizontal view in cross-section of a tenter clip taken on line B—B of FIG. 3.

FIG. 1 shows a cross-section of a clip chain track 1 composed of a clip chain support 2 with tenter clips 4 guided therein and linked into a chain. The tensioning plane 3 for the length of material to be treated is shown in dash-dot manner. The tensional transverse force acting on the clip chain, i.e., on the individual tenter clips, is indicated by an arrow Q. FIG. 1 shows only that part of the clip chain track used for the advance of the chain. The part used for the reverse motion is of similar design and may, for instance, be linked to the right hand side of the clip chain support 2. The design is indicated in FIG. 1 by the dash-dot center line M of the clip chain support 2.

A vertical spindle 10 is connected with the clip body 9 of the tenter clip 4 where this spindle 10 is perpendicular to the tensioning plane 3 and extends to both sides thereof. Rollers to guide the tenter clip 4 are arranged in different planes on the spindle 10 both above and below the tensioning plane 3 and essentially symmetrically thereto.

Separate support rollers 12 and 12' are provided in the transverse planes 5 and 6 located at the two ends of the spindle 10, which absorb the vertical forces acting on the clip chain. These two support rollers have slanted running surfaces 13 of opposite inclinations. The slanted running surface 13 may be conical, as indicated for instance for the upper support roller 12 located in the transverse plane 5, or the running surface 13 also may selectively be made concave, as indicated for instance for the lower support roller 12′ in the transverse plane 6. The support rollers 12 and 12′ rest by means of their oppositely inclining running surfaces 13 against the support rails 8 and 8′, respectively, which also are arranged in the transverse planes 5 and 6, respectively, and they bear the weight of the clip chain, i.e., they prevent an undesired rise of the chain during operation. The relatively thin support rails consist of endless, longitudinally movable, flexible rods, wires or the like held by the clip chain support 2 on its side facing the sheet material. The design of the support rails 8 and 8′ is the same as the design of the running rails 7 and 7′, respectively, discussed further below.

Two running rollers 11 and 11′ are also arranged approximately symmetrically to the tensioning plane 3, further on the inside on the common spindle 10 and in the transverse planes 5′ and 6′. These running rollers 11 and 11′ absorb only the horizontal forces generated in operation and rest by their running surfaces 14 against associated running rails 7 and 7′, respectively, which are located approximately in the same transverse planes. The running surfaces or running rims 14 of the running rollers 11 and 11′ may be of a cylindrical design, but also they may be conical or concave similar to the support rollers 12 and 12′. The cylindrical shape allows easy adaptation to the vertical operational play of the clip chain, whereas running rollers with slanted running surfaces should be provided with a relatively tight play.

It is important as regards the arrangement of the support and running rollers that the support rails rest against the running surfaces of their associated rollers 12 and 12′ from one side of the common spindle 10 and that the running rails 7 and 7′ rest against the running surfaces of their associated rollers 11 and 11′ from the other side of the spindle 10.

As regards the arrangement of the support rails and support rollers shown in the figure, the support roller 12′ in cooperation with the support rail 8′ bears the weight of the clip chain. If the inclinations of the running surfaces 13 in the support rollers 12 and 12′ were exchanged, the weight of the clip chain would be hanging from the support roller 12 which together with the support rail 8 would absorb this weight. In both cases, the support rails 8 and 8′ and the support rollers 12 and 12′ also absorb the horizontal forces generated by the loading from the transverse tensional force Q. The running rails 7 and 7′ mounted to the center web of the clip chain support 2 in that case serve only to horizontally guide the clip chain in the unloaded condition, when no transverse tensional force Q is effective. In the last case, the running rollers 11 and 11′ then rest against the running rails 7 and 7′.

As already briefly mentioned above, the positions of the support rails 8 and 8′ and those of the running rails 7 and 7′ may be interchanged, somewhat in the manner that the running rails are mounted on that side of the clip chain support which faces the length of material and that the support rails 8 and 8′ are mounted on the side away from the length of material, that is, at the center web of the clip chain support 2. In this case, it is the running rails 7 and 7′ which would absorb the full generated transverse tensional force Q and they would relieve the support rails 8 and 8′ in this respect.

Another variation which is possible is to interchange, if necessary, also the locations of the rollers on the common spindle 10. For instance, the support rollers 12 and 12′ may be arranged in the transverse planes 5′ and 6′, or the running rollers 11 and 11′ may be arranged in the transverse planes 5 and 6.

Due to the running and support rollers being arranged on a common spindle, the spacing between the clip table and its pivot shaft is reduced, and thereby the edges of the length of material will be only slightly stretched in the longitudinal direction when in the transverse stretching zone. Moreover, the dripping of lubricants onto the clip table and the ensuing soiling of the edges of the sheet material are thereby practically precluded, this being insured by a metal catch 15 additionally arranged above the clamping plane 3 between the pair of running and support rollers 11, 12 and the clip body 9.

In the embodiment of FIGS. 2 to 4, the clip body 9 is composed of a U-shaped part with horizontal pieces mounted above and below. The two spindles 10 for the running and support rollers are seated in non-rotatable manner in the two horizontal pieces of the clip body. The clamping parts of the clip 4 are seated in a manner not described in detail—for instance by means of vertical guide grooves—in the clip body 9. The drawing indicates the pivotal flap 4*a* and the clip table 4*b*. These two parts together form the clamping means of the tenter clips. The clamping plane 3 for the sheet material to be treated passes again at the height of the clip table 4*b*.

The clip bodies 9 are part of an endless revolving chain; they are joined by the intermediate links 16. The intermediate links 16 are in the shapes of yokes composed of two approximately cylindrical parts 16*a* with an upper and lower connecting strap 16*b*. The vertical parts16*a* and the horizontal parts 16*b* thus enclose a clear window 16*c*. The cylindrical parts 16*a* are provided with a borehole for the rotatable support of the spindles 10. In this manner, the two horizontal U-shaped legs of the clip body 9 and the cylindrical parts 16*a* acting as junction means of the intermediate links 16 together with the inserted spindles 10 form the chain linkages. The spacings between the two spindles 10 in a clip body 9 and the spacings between two spindles of adjacent clips are equal. In this manner, gaps are created in the region of the clip bodies 9 and also in the region of two intermediate links connecting two clip bodies which correspond to the above-mentioned clear windows 16*c*. The teeth of the drive wheel actuating the revolving clip chain enter these gaps or the windows 16*c*. The drive wheel 17 is indicated in phantom in FIGS. 2 and 4.

The support rollers 12 and 12′ are again mounted in the transverse planes 5 and 6 of the spindles 10 shown in dashed lines and the running rollers 11 and 11′ in the transverse planes 5′ and 6′ of the spindles 10 also in dashed lines. The transverse planes are defined by the contact lines between the rollers and their associated running or support rails.

In contrast to the construction of FIG. 1, the position of the support rails 8, 8′ is interchanged with that of the running or guide rails 7, 7′ in FIG. 2. Hence the running rails 7,7′ are mounted to the left of the sheet material, while the support rails 8, 8′ are located on the right-hand side, i.e., away from the sheet of material. The fastening of the rails at the chain track support 2 indicated in phantom and the special design of the flexible rails are no part of the invention and therefore are not described in further detail.

The arrangement of the running rollers 11, 11' in the transverse planes 5' and 6' is essentially symmetrical with respect to the clamping plane and advantageous because the transverse tensional forces occurring in operation will be distributed most uniformly. Such a distribution of the transverse tensional forces is also achieved in FIG. 1 for the support rollers 12, 12' which absorb both the transverse forces and the weight of the clip chain during operation.

An approximately symmetrical arrangement of the support rollers 12, 12' also can be provided in FIG. 2. In this case, each spindle 10 carries a support roller and a running roller above and below the clamping plane 3. However, it is also possible in FIG. 2 to have two support rollers per tenter clip and to provide in addition to the two running rollers 11, 11' only one support roller on each spindle 10, for instance only the support roller 12' in the lower transverse plane 6. It is especially advantageous, as indicated in FIG. 3, to alternatingly mount one support roller 12' and 12 in the lower transverse plane 6 of the one spindle 10 and in the upper transverse plane 5 of the other spindle 10, respectively. The transverse planes 5 and 6 are essentially spaced equally from the clamping plane 3. What is important in every case is that the transverse tensional forces, which must be absorbed in a tenter clip during operation, are essentially symmetrically distributed, i.e., that they be absorbed by a total of four rollers mounted above and below the clamping plane 3. A corresponding condition of symmetry for the support rollers is less important, but the above stated obliquely offset or central arrangement of FIG. 3 is advantageous for the operation.

It will be obvious to those skilled in the art that many modifications may be made within the scope of the present invention without departing from the spirit thereof, and the invention includes all such modifications.

What I claim is:

1. In a clip-chain track for tenter clips, with roller guidance in tenter frames for sheet material, composed of a clip-chain support with rod-like, endless and jointless guide rails of small cross-section mounted pairwise to the clip-chain support on both sides of the tensioning plane of the tenter chain, and with tenter clip rollers resting by their running surfaces against said guide rails, the improvement comprising a pair of vertical spindle means connected to a clip body of each said tenter clip and mounting separate support rollers and running rollers on both sides of a tensioning plane of a sheet material in two separate transverse planes on each of said spindle means, with the support rollers absorbing vertical forces and having slanted running surfaces of opposite inclinations, and separate support rails mounted on one side of their associated support rollers and running rails mounted on the other side of their associated running rollers in the said transverse planes at the clip-chain support.

2. A clip-chain track according to claim 1 in which the running surface of the support rollers is conical.

3. A clip-chain track according to claim 1 in which the running surface of at least one of the running rollers is cylindrical.

4. A clip-chain track according to claim 1 including catch means above the tensioning plane between the pair of running rollers and the clip body.

5. A clip-chain track according to claim 1 wherein said running rollers are mounted on said spindles on both sides of an in approximately mirror-symmetrical manner with respect to the tensioning plane of the sheet material, said rollers resting against a pair of rails facing the length of material and absorbing transverse tensional forces, and said support rollers comprise at least one additional roller mounted on each spindle and resting against a rail mounted on the chain track support away from the length of material.

6. A clip-chain track according to claim 1 in which said support rollers absorbing vertical forces are mounted pairwise and in approximately mirror-symmetrical manner with respect to said tensioning plane and have slanted running surfaces of opposite inclinations.

7. A clip-chain track according to claim 1 in which a support roller is mounted on one of said spindles below the tensioning plane of the sheet material and a support roller is mounted on the other of said spindles above said tensioning plane, said support rollers having slanted running surfaces of opposite inclinations, and said associated support rails being mounted on the chain track support away from the length of material.

* * * * *